United States Patent [19]

Rebsamen et al.

[11] Patent Number: 4,796,418

[45] Date of Patent: Jan. 10, 1989

[54] APPARATUS FOR JOINING TWO THREAD ENDS BY SPLICING

[75] Inventors: Arthur Rebsamen, Stallikon; Bruno Hablützel, Horgen, both of Switzerland

[73] Assignee: Maschinenfabrik Schweiter AG, Horgen, Switzerland

[21] Appl. No.: 33,521

[22] Filed: Apr. 1, 1987

[30] Foreign Application Priority Data

Apr. 5, 1986 [CH] Switzerland ..... 1330/86

[51] Int. Cl.[4] ..... D01H 15/00

[52] U.S. Cl. ..... 57/22

[58] Field of Search ..... 57/22, 263

[56] References Cited

U.S. PATENT DOCUMENTS 4,229,935 10/1980 Wain ..... 57/22

FOREIGN PATENT DOCUMENTS 145075 11/1981 Japan ..... 57/22

2074199 10/1981 United Kingdom ..... 57/22

*Primary Examiner*—Donald Watkins

*Attorney, Agent, or Firm*—Helfgott & Karas

[57] ABSTRACT

Two parallel-inserted thread ends are introduced into a thread end preparation device via an air gap located above a preparation tube. The thread ends are cut by shears and thereafter an air flow produced in an air intake tube blows the thread ends into the preparation tube. The prepared thread ends are brought by retracting levers into the vicinity of the splicing chamber. The splicing chamber is provided with a cover and splicing is carried out by supplying a compressed air flow.

Two thread ends are spliced together after cutting by exposing the two ends to a single air flow to prepare the ends for splicing by untwisting the ends and removing loose thread parts therefrom. The cut and prepared ends are disposed in a splicing chamber and compressed air is passed through the chamber to splice the ends together.

6 Claims, 2 Drawing Sheets

APPARATUS FOR JOINING TWO THREAD ENDS BY SPLICING

BACKGROUND OF THE INVENTION

The present invention relates to a method and apparatus for joining two thread ends by splicing.

The joining of thread ends by splicing has largely displaced the previously widely used knotting of the thread ends, because splicing leads to connections differing little from the remaining thread as regards strength and shape.

Different apparatuses for producing splices are known, U.S. Pat. No. 4,263,775 disclosing an apparatus representing most of the known constructions. In this apparatus, in the case of a thread break, the thread ends are received by suction nozzles and brought into the vicinity of a splicing device, which has a splicing chamber subject to the action of compressed air. However, in order to provide a clean splice, the thread ends must be cut clean by cutting devices. The cut ends are then sucked into the thread end preparation tube subject to suction pressure. One such preparation tube is required for each thread end. In said preparation tubes, the thread ends are untwisted by a compressed air flow and loose thread portions are removed. After thread end preparation, the thread end are retracted or drawn back to such an extent that they are located in or alongside the splicing chamber and this is followed by the splicing of the thread ends by supplying compressed air to the splicing chamber. It is necessary for such splicing that one thread end is inserted into the chamber from one side of a splicing device and the other thread end is inserted from the other side of the device. It must be borne in mind that this construction, in which a single preparation tube is associated with each thread end, constitutes a relatively complicated solution, because such preparation tube must be controlled in such a way that initially a suction flow and then, for the actual thread end preparation, a pressure flow is produced.

The present invention provides a method of apparatus for joining two thread ends by splicing in such a way that the manufacturing effort and expenditure is reduced and also so that there is improved reliability concerning thread end preparation, while obtaining a splice with the same quality as with the known methods and apparatuses.

SUMMARY OF THE INVENTION

According to the invention, after cutting, the thread ends are joined together by means of exposure to a single air flow and jointly undergo preparation therein.

More particularly, after cutting, the two ends are exposed to a single air flow to prepare these ends for splicing by untwisting the ends and removing loose thread parts therefrom. The two cut and prepared ends are placed in a splicing chamber. Compressed air is directed through the chamber upon the ends to splice them together.

The aforementioned objects and advantages of the invention as well as other objects and advantages thereof will either be explained or will become apparent to those skilled in in the art when this specification is read in conjunction with the accompanying drawings and specific description of preferred embodiments which follow.

DETAILED DESCRIPTION OF PREFERRED EMBODIMENTS

Figure 3:
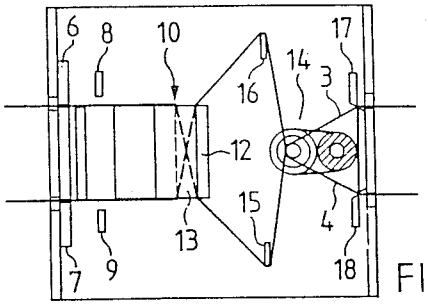
FIG. 3 is a plan view of the apparatus diagrammatically illustrating insertion of the thread ends in the splicing chamber and the cutting thereof.

FIGS. 1 to 7 show threads 1, 2, whose thread ends 3, 4 are inserted parallel to one another in an apparatus 5 for joining said thread ends by splicing. Insertion takes place in known manner by means of two (not shown) suction nozzles, which seek the thread ends 3, 4 after a thread break has occurred, subject same to a suction action and bring same into the parallel position shown in FIG. 1. Apparatus 5 has all the necessary means for carrying out thread end preparation and subsequent splicing. The two threads 1, 2 are located between two clips 6, 7, which secure the threads during preparation and splicing. The two clips 6, 7 are followed by two retracting levers 8, 9 which retract thread ends 3, 4 to such an extent that they can be spliced in a splicing chamber 10 of apparatus 5. Splicing chamber 10 comprises a splicing chamber body 11 and a cover 12. Splicing chamber body 11 has a splicing slot 13, in which the thread ends 3, 4 are inserted for splicing purposes. During splicing, the pivotable cover 12 closes splicing slot 13 to form a tubular channel.

Figure 2:
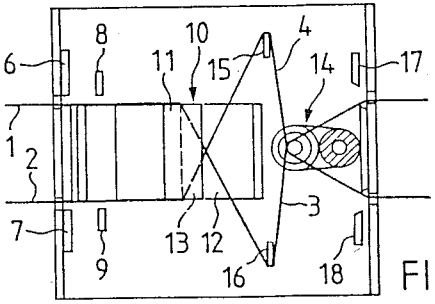
FIG. 2 illustrates diagrammatically, in plain view, the apparatus for the crossing of the thread ends by means of crossing of the thread ends by means of crossing levers, which are positioned between a splicing chamber and a preparation tube.
Figure 1:
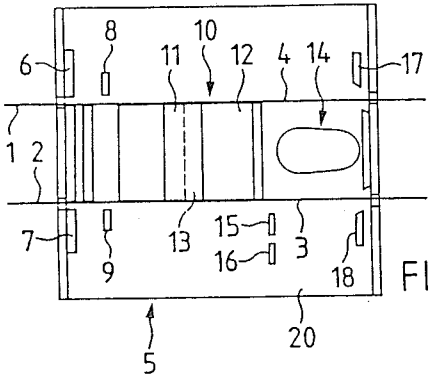
FIG. 1 illustrates the insertion of the two threads into the apparatus for joining the thread ends by splicing.

Between splicing chamber 10 and a thread end preparation device 14 are pivotably arranged two crossing levers 15, 16, which are designed in such a way that crossing lever 15 draws out one thread end and crossing lever 16 the other thread end, so that thread ends 3, 4 are crossed, as shown in FIG. 2. The crossing of thread ends 3, 4 simultaneously leads to the extension thereof over the thread end preparation device 14. During crossing, thread ends 3, 4 are still held by the not shown suction nozzles. Threads ends 3, 4 are located between the opened cutting edges of two shears 17, 18, which are located on the side of the thread end preparation device 14 remote from splicing chamber 10. Clips 6, 7, retracting levers 8, 9 splicing chamber 10, thread end preparation device 14, crossing levers 15, 16 and shears 17, 18 are arranged on a base 20 of apparatus 5. The function of the thread end preparation device 14 will be explained below.

FIG. 3 shows the further course of thread end preparation. Cover 12 of splicing chamber 10 is closed and the thread ends are cut by shears 17, 18. The cut-off ends are sucked through the not shown suction nozzles. Simultaneously an air flow is produced in the thread end preparation tube 14, which leads to the sucking or blowing in of the thread ends 3, 4 already located in the vicinity of said tube. It is important that the two thread ends 3, 4 are sucked into the same thread end preparation tube. The thread ends 3, 4 are now retracted by retracting levers 8, 9 to such an extent against the splicing chamber 10 that splicing can be carried out by a compressed air flow introduced through the splicing slot 10 closed by cover 12. When splicing is at an end, the spliced part of threads 1, 2 is removed from the splicing slot 13 in known manner by levers (not shown).

Figure 5:
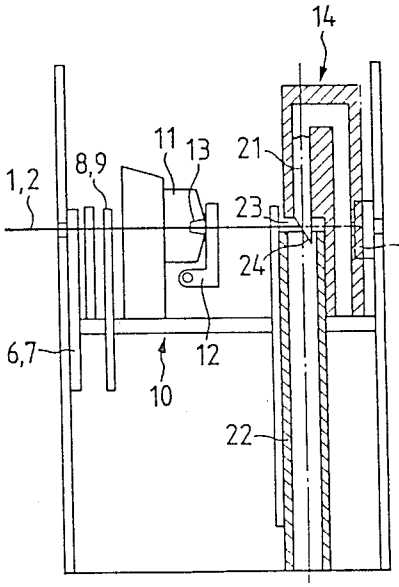
FIG. 5 illustrates the closing of the splicing chamber in accordance with FIG. 3, but showing the apparatus in an elevation view.
Figure 4:
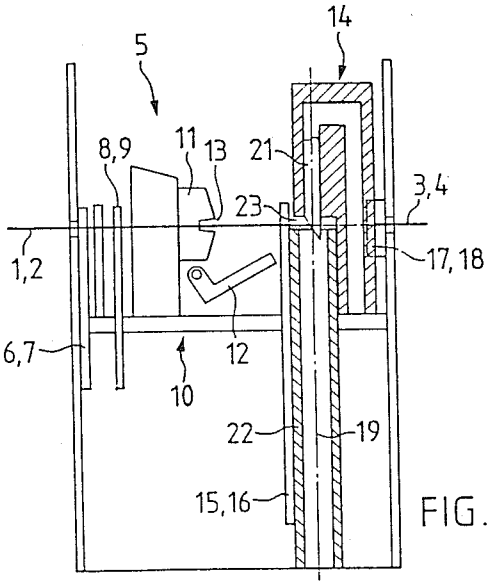
FIG. 4 illustrates the crossing of the thread ends in accordance with FIG. 2, but showing the apparatus in an elevation view.

FIGS. 4 and 5 are side views, partly in section which in FIG. 4 shows the crossing of the thread ends 3, 4 according to FIG. 2, while FIG. 5 shows the closing of cover 12 and the cutting off of the threads according to FIG. 3. In FIG. 4 the crossed thread ends have been placed in splicing slot 13, but cover 12 is still not closed. In FIG. 5 cover 12 is closed and shears 17, 18 are operated for cutting off the threads ends 3, 4.

FIGS. 4 and 5 also show the construction of the thread end preparation device 14. The latter comprises an air intake tube 21 and a coaxial preparation tube 22 connected to the mouth thereof. The mount or opening 24 of air intake tube 21 has a surface sloping toward the tube axis 19. According to FIGS. 2 and 3, when thread ends 3, 4 cross, they pass through an air gap 23 into the thread preparation device 14 and are placed on the mount 24 of air intake pipe 21 and are located over the cross-section of preparation tube 22. If thread ends 3, 4 are now cut by shears 17, 18, the cut thread ends can easily be sucked into the thread end preparation device 14, either by a compressed air flow in air intake tube 21, or by a suction flow in preparation tube 22.

FIGS. 2 and 3 also shown that the air gap 23 extends over the entire circumference of preparation tube 21. However, according to FIG. 6 it would also be possible for air gap 23 to extend over only part of the circumference of the preparation tube.

Figure 6:
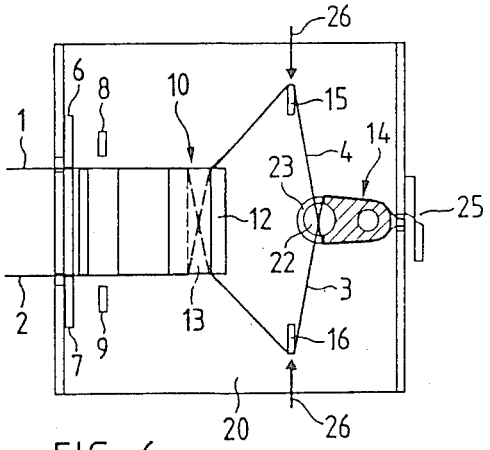
FIG. 6 is a diagrammatically represented plan view of another embodiment of the apparatus shown in FIGS. 1 to 5.

FIG. 6 shows a variant of the thread end preparation device 14. As stated, the difference is that the air gap 23 only extends over part of the circumferences of preparation tube 22. A further difference is that there is only one shear 25, for shortening the two thread ends 3, 4. In this arrangement, the threads ends can extend over the cross-section of the preparation tube 22 without application to the mouth 24 of the air intake tube. FIG. 6 also shows that the crossing levers 15, 16 can be adjusted for modifying the length of thread ends 3, 4 following the cutting thereof, as indicated by arrow 26 in FIG. 6. This adjustment possibility with respect to crossing levers 15, 16 can naturally also be used in the thread end preparation device 14 according to FIGS. 1 to 5. It is important that the yarn end length in preparation tube 22 can be adapted during the preparation process to the yarn characteristics, particularly the yarn staple length for optimum opening and parallelization. This adjustment possibility can also be provided for retracting levers 8, 9.

Figure 7:
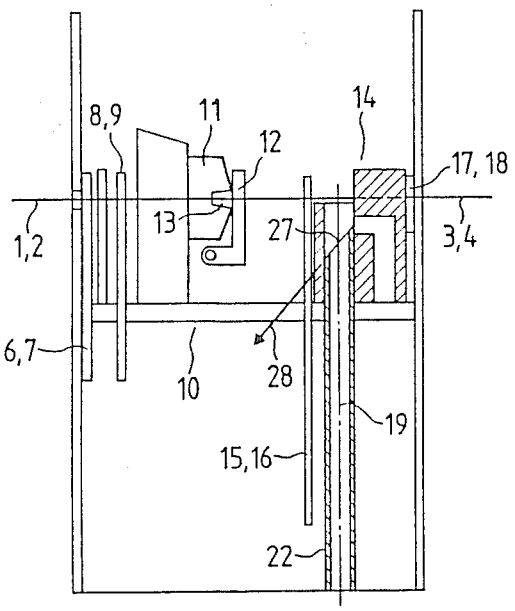
FIG. 7 is a diagrammatically represented plan view of yet another embodiment of the apparatus shown in FIGS. 1 to 5.

FIG. 7 shows another variant of the thread end preparation device 14. In place of a coaxial air intake tube 21, in the the vicinity of the crossing point of thread ends 3, 4 at the upper end of preparation tube 22, there is an opening 27 which slopes towards tube axis 19 and whose direction is indicated by arrow 28. As a result a compressed air flow can be produced in preparation tube 22 which, following the cutting of of the thread ends, sucks them into the preparation tube and prepares the same. In FIG. 2, there are two shears 17, 18 for cutting thread ends 3, 4, but there need only be a single shear 25, which cuts both thread ends.

Figure 8:
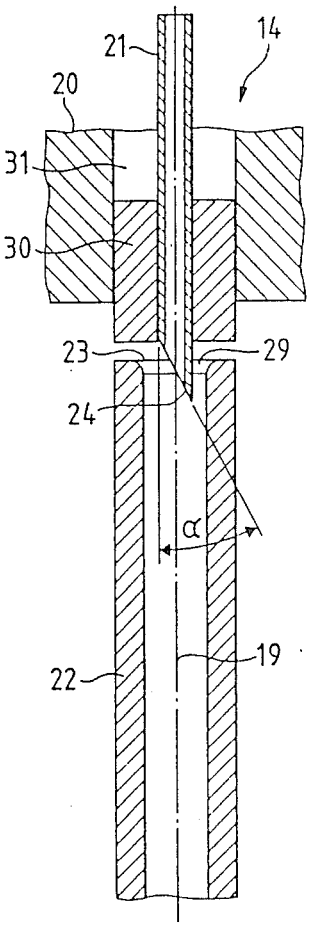
FIG. 8 is a diagrammatically represented longitudinal section through a thread and preparation nozzle shown in larger scale than in the other figures.

FIG. 8 shows on a larger scale the thread end preparation device 14 according to FIGS. 1 to 5. The sloping mouth 27 of air intake pipe 21 projects into the rounded opening 29 of preparation tube 22. The angle of the plane of mouth 27 is approximately 45°, but a variation in the range 35° to 70° is possible. The air intake tube 21 is embedded in a cylindrical bearing 30 and is longitudinally displaceable and rotatable therein. Bearing 30 is also longitudinally displaceably and rotatably mounted in a bore 31 of base 20. Thus, it is possible to bring about an optimum adaptation of the thread end preparation device 14 to the particular thread material to be processed. This also applies to the air intake tube 21, which is also adjustable.

It is important that in preparation tube 22 both the thread ends 3 and 4 are prepared, i.e. untwisted and freed from any loose thread parts. Through the use of only a single thread end preparation device 14, the air supply is simplified. Importance is attached to the position of the two thread ends 3, 4 sucked into the preparation tube 22 after cutting. Particularly good results during the subsequent splicing are obtained with approximately diametrically facing thread ends, i.e. in the case of a position angle of 180°±60°, because then adhesion of the thread ends is avoided. Splicing chamber 10 can also be constructed without a cover 12 and then the insertion of the thread ends can take place with known means. If use is only to be made of the quality of the preparation of the described device 14 in other, known splicing apparatuses, it is possible to use for each thread end a separate preparation device 14, e.g. according to FIG. 8.

If crossing levers 15, 16 are used for crossing the thread ends 3, 4, they are positioned between splicing chamber 10 and the thread end preparation device 14. Although this can lead to the retraction path of the thread ends being somewhat larger, this can be controlled in troublefree manner. However, the solution with crossing levers 15, 16 is a tried and space-saving solution. However, the described device 14 can obviously also be used in splicing apparatuses, in which threads 1, 2 are not parallel and have instead already been brought into an opposite directed position in the vicinity of the splicing chamber, where once again there is one device 14 per thread end.

While the fundamental novel features of the invention have been shown and described and pointed out, it will be understood that various substitutions and changes in the form of the details of the embodiments shown may be made by those skilled in the art without departing from the concepts of the invention as limited only by the scope of the claims which follow.

What is claimed is:

1. Apparatus for splicing together two thread ends which are disposed in spaced parallel position and are subsequently cut, said apparatus comprising:

first means to subject the two cut ends to a single air flow to prepare the ends by untwisting them and removing loose thread parts therefrom;

second means to place the prepared ends in a splicing chamber; and third means to direct compressed air upon said ends in the chamber to splice together said ends, said first means including a single thread end preparation device at least partially constructed as a preparation tube, said device having an air gap for thread end introduction which is disposed at right angles to the preparation tube, said device having an air intake tube having an axis and a discharge mouth defining a surface disposed at an angle less than ninety degrees with respect to the axis of the tube.

2. Apparatus of claim 1, wherein the tube receives at least one of the ends and wherein the air flow is produced in the tube.

3. Apparatus of claim 1 wherein said angle is greater than fifteen degrees and less than seventy five degrees and preferably falls within the range of thirty to sixty degrees.

4. Apparatus of claim 1 wherein the air gap extends over part of the circumference of the preparation tube.

5. Apparatus of claim 1 wherein the device is spaced from the splicing chamber, the apparatus further including crossing levers for crossing the ends disposed in the gap.

6. Apparatus of claim 5 further including fourth means, including at least one shear for cutting the ends, said device being disposed between the fourth means and the splicing chamber.

* * * * *